US005488913A

United States Patent [19]

Fumanelli

[11] Patent Number: 5,488,913

[45] Date of Patent: Feb. 6, 1996

[54] APPARATUS FOR AUTOMATICALLY RECEIVING AND DISPENSING BANKNOTES AND VALUABLES

[75] Inventor: Giuseppe E. Fumanelli, Melzo, Italy

[73] Assignee: M.I.B. Elettronica S.r.l., Peschiera Borromeo, Italy

[21] Appl. No.: 172,814

[22] Filed: Dec. 27, 1993

[30] Foreign Application Priority Data

Dec. 30, 1992 [IT] Italy ..... MI92A2991

[51] Int. Cl.[6] ..... E05G 1/00

[52] U.S. Cl. ..... 109/45; 109/46; 109/55; 109/24.1

[58] Field of Search ..... 109/45–49, 54–58, 109/24.1, 66; 70/1.5

[56] References Cited

U.S. PATENT DOCUMENTS

| | | | |
|---|---|---|---|
| 1,954,668 | 4/1934 | Ernst | 109/46 |
| 1,961,662 | 6/1934 | Gamache | 109/46 |
| 2,963,333 | 12/1960 | Mestre | 109/46 X |
| 4,548,353 | 10/1985 | Howard et al. | 109/48 X |
| 4,669,393 | 6/1987 | Wuthrich | 109/47 X |
| 5,016,546 | 5/1991 | Haueter | 109/45 |

FOREIGN PATENT DOCUMENTS

| | | | |
|---|---|---|---|
| 0182137 | 5/1986 | European Pat. Off. . | |
| 0379638 | 8/1990 | European Pat. Off. . | |
| 0385650 | 9/1990 | European Pat. Off. . | |
| 2079019 | 1/1982 | United Kingdom . | |
| 2083549 | 3/1982 | United Kingdom | 109/55 |

*Primary Examiner*—Steven N. Meyers
*Assistant Examiner*—Suzanne L. Dino
*Attorney, Agent, or Firm*—Browdy and Neimark

[57] ABSTRACT

Apparatus for automatically receiving and dispensing banknotes and valuables comprising a protection casing (2) provided with access openings (3, 4), compartments (7) adapted to contain banknotes and valuables and movable along a loop-shaped movement path (6) extending within the protection casing (2) and passing close to the access openings (3, 4), drive and guide means (9) for moving the compartments (7), and electronic means (35) acting on the drive and guide means (9) and designed to select the compartments (7) to be positioned close to the access openings (3, 4), based on predetermined procedures and commands.

10 Claims, 4 Drawing Sheets

Fig. 5
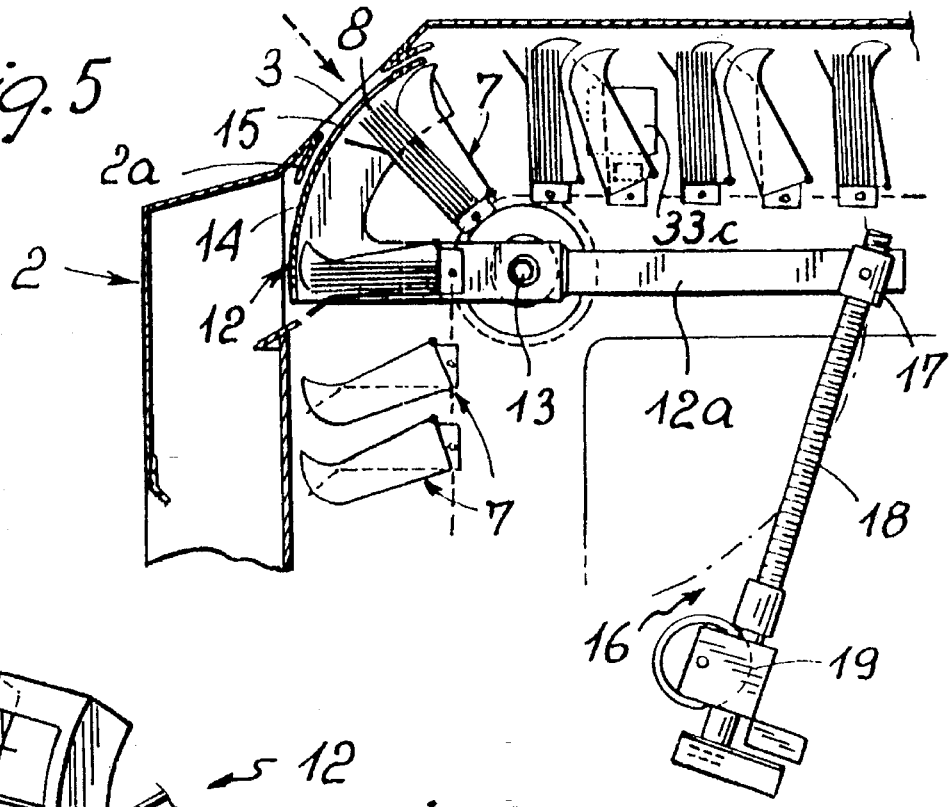
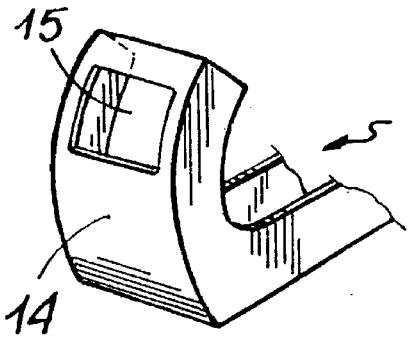
Fig. 7
Fig. 6
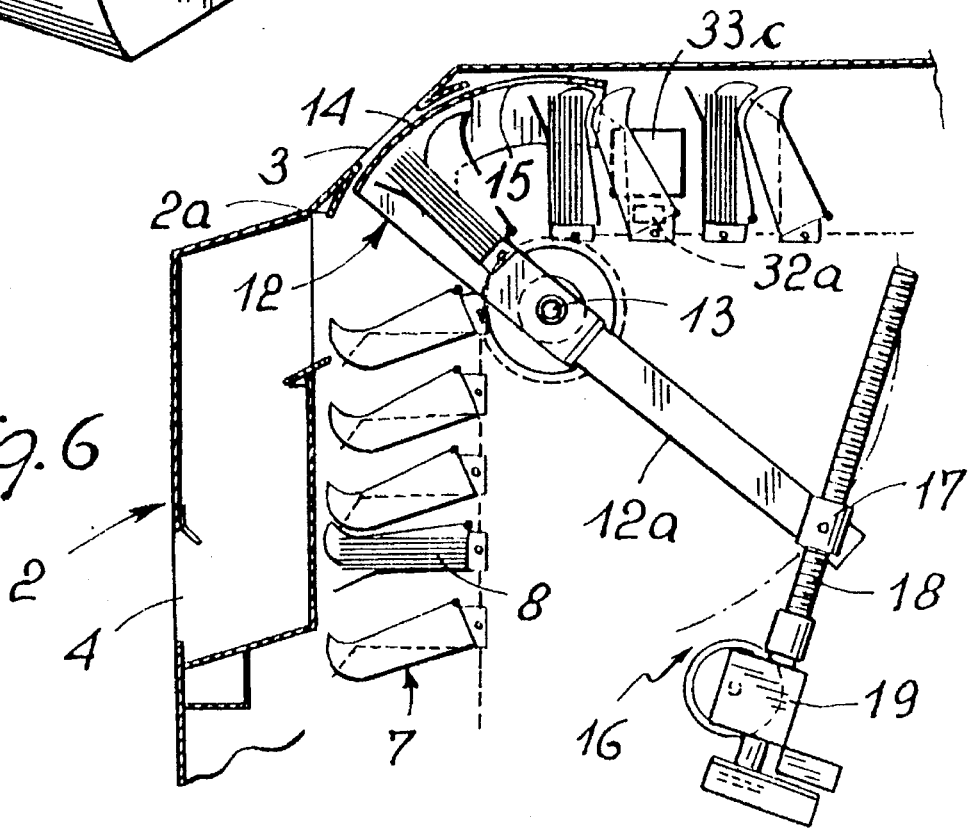

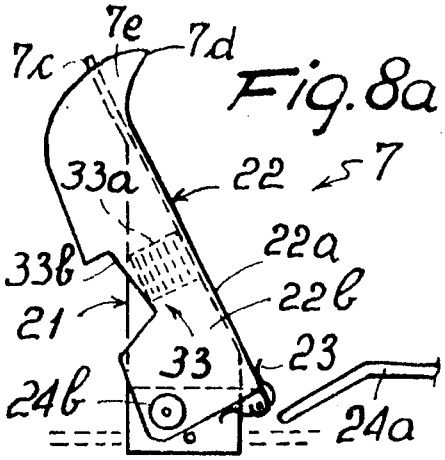
Fig. 8a
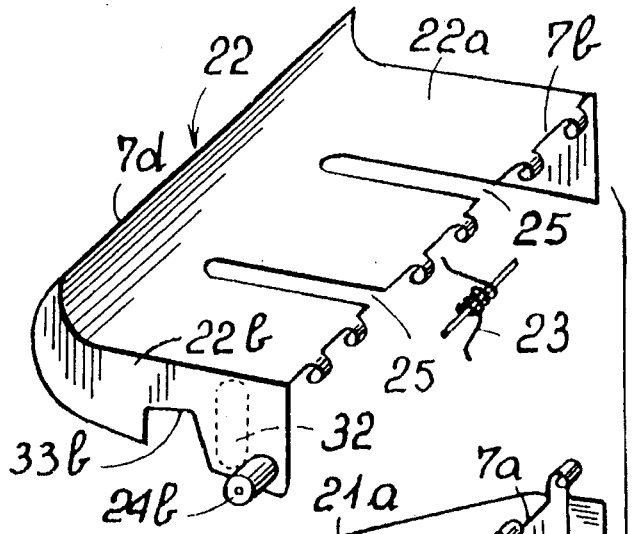
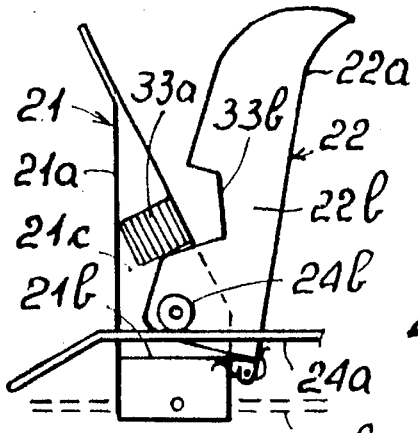
Fig. 8b
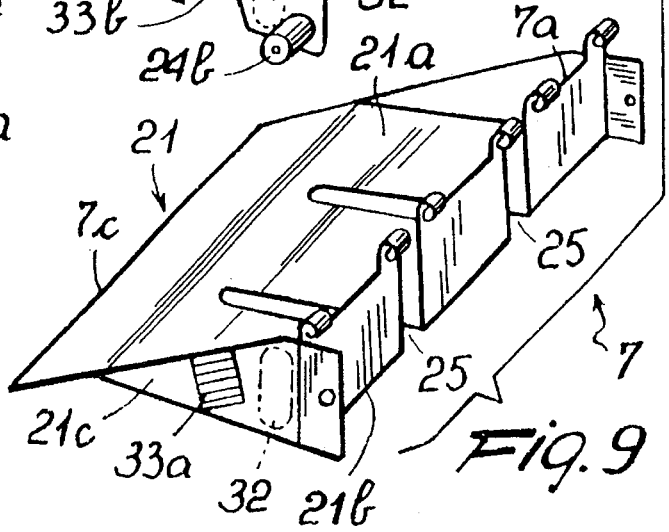
Fig. 9
Fig. 8c
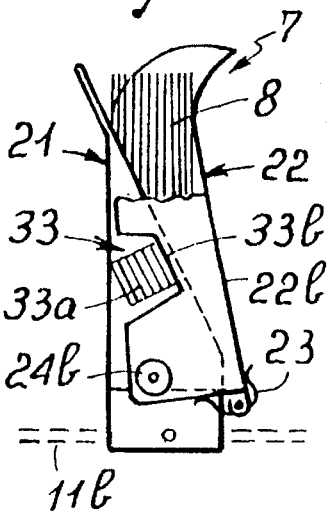
Fig. 10
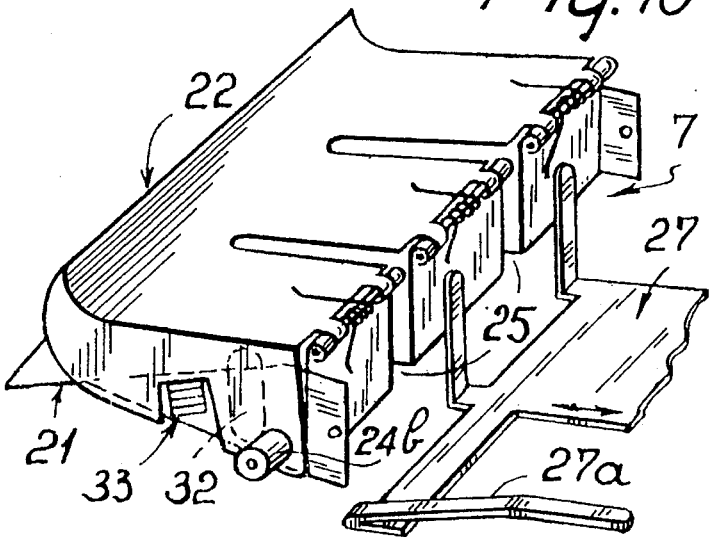

APPARATUS FOR AUTOMATICALLY RECEIVING AND DISPENSING BANKNOTES AND VALUABLES

BACKGROUND OF THE INVENTION

The present invention relates to an apparatus and a method for automatically receiving and dispensing banknotes and valuables.

It is known that banknotes and valuables are usually protected by resorting to safety containers such as safes and armor-plated cabinets.

Such safety containers however can represent an obstacle or be of difficult management when frequent paying-in or withdrawing operations are to be carried out, such as in a bank for example. At the bank counters such paying-in or withdrawing operations are also slowed down by the fact that counting and control of the handled banknotes is required. In addition to requiring rather important operating times for managing said safety containers and carrying out said countings, the presently adopted technique has the drawback that in many cases it does not allow the overall money amounts present to be maintained constantly under control. In fact such a control involves the execution of suitable and laborious calculations that usually can be carried out only at the beginning and at the end of a work shift.

SUMMARY OF THE INVENTION

Under this situation, it is an object of the present invention to obviate the above drawbacks.

The object specified is substantially attained by an apparatus for automatically receiving and dispensing banknotes and valuables, comprising: a protection casing, at least a first access opening formed in said protection casing, compartments adapted to contain banknotes and valuables, supported by said protection casing, drive and guide means for said compartments, a movement path for each of said compartments, controlled by said drive and guide means, shaped as a closed loop and extending within said protection casing, said movement path comprising at least one location disposed close to said at least a first access opening, and electronic means acting on said drive and guide means and adapted to cause the positioning of each of said compartments relative to said at least a first access opening, based on predetermined procedures and commands.

BRIEF DESCRIPTION OF THE DRAWINGS

The description of a preferred embodiment of the invention is now given hereinbelow with reference to the accompanying drawings, in which:

FIG. 5 shows a portion of FIG. 2 and illustrates a first operating step of a movable partition of the apparatus;

FIG. 6 shows a second operating step of the movable partition of FIG. 5;

FIG. 7 is a perspective view of a detail of the apparatus, seen separately;

FIG. 8*a* is part sectional side view of one compartment of the apparatus in a closed and empty configuration.

FIG. 8*b* is a part sectional view of the compartment of FIG. 4 in an open and empty configuration;

FIG. 8*c* is a part sectional view of the compartment of FIG. 4 in a substantially filled configuration;

FIG. 9 is an exploded perspective view of the compartment shown in the preceding figures; and FIG. 10 is a diagrammatic perspective view of the compartment shown in the preceding figures, disposed close to an emptying device thereof.

DETAILED DESCRIPTION OF THE INVENTION

Figure 1:
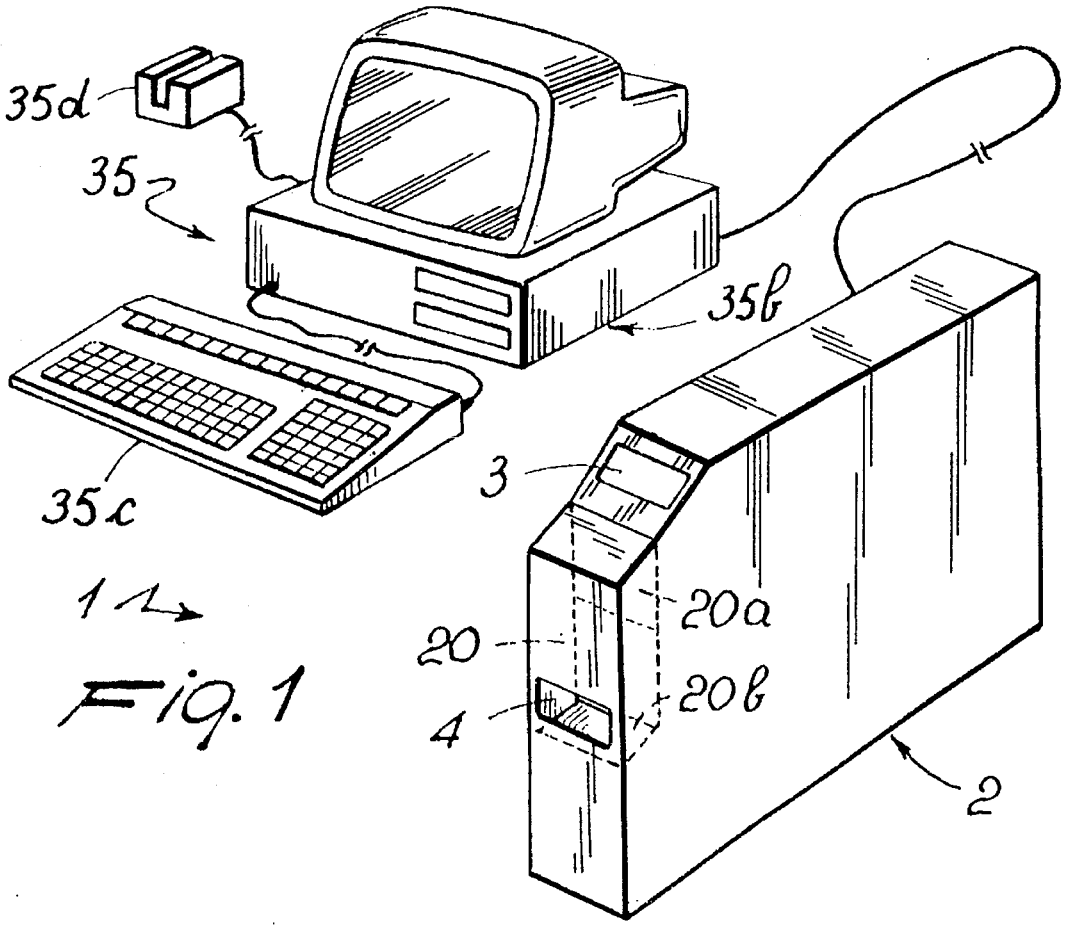
FIG. 1 shows the apparatus taken as a whole.

Referring to the drawings, the apparatus in accordance with the invention has been generally denoted by reference numeral 1.

It comprises a protection casing 2 exhibiting features of high strength and provided with at least one access opening at the inside thereof, and preferably two access openings: a first access opening 3 for loading banknotes or valuables and a second access opening 4 for emitting them.

Disposed within the protection casing 2 is at least one discontinuous movable unit 5 which as a whole is substantially loop-shaped.

The discontinuous movable unit 5 travels over an endless path 6 within the protection casing 2 and passes through locations disposed close to the access openings 3 and 4.

As shown in the drawings, the unit 5 consists of a plurality of compartments 7 independent of, and separated from each other, and mutually connected in succession through flexibile elements, so as to form a loop as a whole, where each compartment 7 is spaced apart the same distance from the preceding and following ones. Each compartment 7 is such shaped and sized that it can receive and house one banknote pack or group 8.

The endless path 6 is controlled by drive and guide means 9 comprising a reduction gear 10 pulleys or cogwheels 11*a* and chains 11*b* embodying said flexible elements and substantially coinciding, as to the position thereof, with said path 6.

Practically the chains 11*b* are capable of stopping to a plurality of stop positions due to blocking of the reduction gear 10, so that each compartment 7 can be selectively stopped in register with said location disposed close to either the first access opening 3 or second access opening 4. Provided in the vicinity of said openings is a movable partition 12, defined by a shaped body oscillatably engaged to a swinging pin 13 within the protection casing 2. The movable partition 12 has an arcuate portion 14 provided with a passage window 15 and such shaped that it can slide close to a curved region 2*a* of the casing 2 adjacent to the first opening 3.

The movable partition 12 is controlled, in its swinging movement, by actuation means 16, for example comprising a threaded sleeve 17 fitted on an operating screw 18. The threaded sleeve 17 is engaged with an appendage 12*a* of the movable partition 12 and the operating screw 18 is driven by one electric motor 19.

The actuation means 16 is adapted to selectively move the movable partition 12 between a first position and a second position.

In the first position the passage window 15 is at the first opening 3 and enables banknotes and valuables to be inserted, while the remaining arcuate portion 14 of the movable partition 12 closes an outlet 20*a* of an emission channel 20 connected to the second opening 4 (FIG. 5).

In the second position the arcuate portion 14 closes the first opening 3 and the outlet 20*a* is left completely clear (FIG. 6).

The emission channel 20 is shaped in such a manner that it affords a support area 20*b* for the emitted banknotes and in any event prevents access to the inside of the protection casing 2 even in a position at which the movable partition 20 does not interfere with the outlet 20*a*.

Each compartment 7 is defined by a container of varying dimensions, that is expandable depending on the amount of banknotes or valuables housed therein. In fact each compartment 7 exhibits at least two opposite portions adapted to be spaced apart from each other. In the preferred embodiment shown in the drawings each compartment 7 is substantially in the form of a gripper in which said two opposite portions substantially consist of a first jaw 21 and a second jaw 22 oscillatably engaged with each other at the respective first edges 7*a*, 7*b* and exhibiting respective second edges 7*c* and 7*d* opposite to the first ones.

The second edges 7*c*, 7*d* are elastically held close to each other in opposition to any banknotes 8 inserted in the compartments, by closing spring means 23 defined by pin springs or springs subjected to bending.

The first jaw 21 comprises a main plate 21*a* which is bent close to the second edge 7*c*, and a base plate 21*b* transverse to the main plate 21*a* and engaged to the chains 11*b* through endpieces. The base plate 21*b* forms the compartment bottom. Further, there are side plates 21*c* transverse to the main and base plates 21*a*, 21*b*.

The second jaw 22 comprises a main wall 22*a* which is arcuate close to the second edge 7*d* so as to define, in cooperation with the main plate 21*a* , an inlet mouth 7*e*, and two side walls 22*b* contiguous with, and transverse to the main wall 22*a*.

The closing spring means 23 basically keep the jaws 21 and 22 to a tight closed position and moving apart of the second jaw 22 from the first one 21, due to the insertion of banknotes 8 for example, can be effected manually by acting on the inlet mouth 7*e*, or through appropriate opening members preferably located close to the first access opening 3 provided for the introduction of banknotes.

In fact, in this position the compartments 7 can be always open, considering that the movable partition 12 can close the opening 3 if an introduction of banknotes and valuables is not provided.

The opening members can consist of appropriate plungers to be drivingly activated and acting on the second jaw 22, not fastened to the chain 11*b*, or may be merely embodied by a cam 24*a* (FIGS. 8*a* and 8*b*) active on a cam follower 24*b* engaged to the second jaw 22. The cam follower 24*b* can be in the form of a roller.

The first jaw 21 fastened to the chains 11*b*, is also provided with slots 25 defining operating channels for an ejector device 26 provided for dispensing banknotes and valuables along the emission channel 20.

Figure 3:
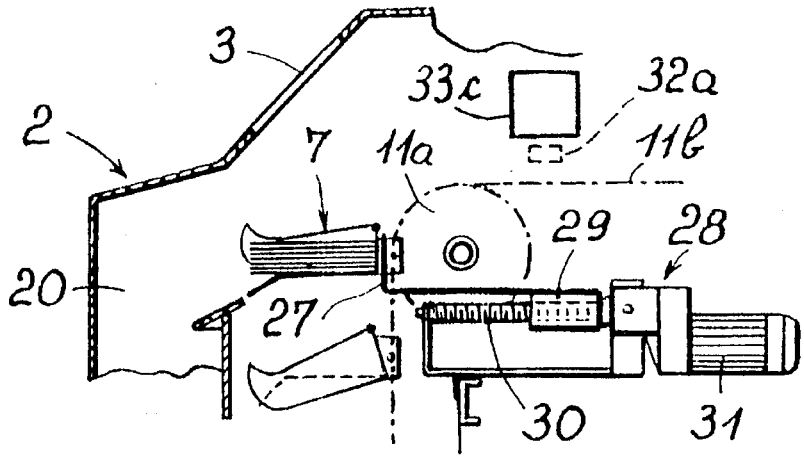
FIGS. 3 shows a portion of FIG. 2 and illustrates first operating step of an ejector device of the apparatus.
Figure 4:
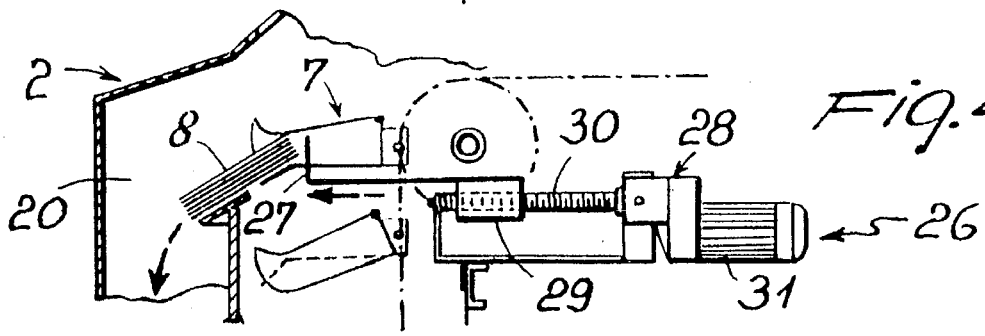
FIG. 4 shows a second operating step of the ejector device of FIG. 3.
Figure 2:
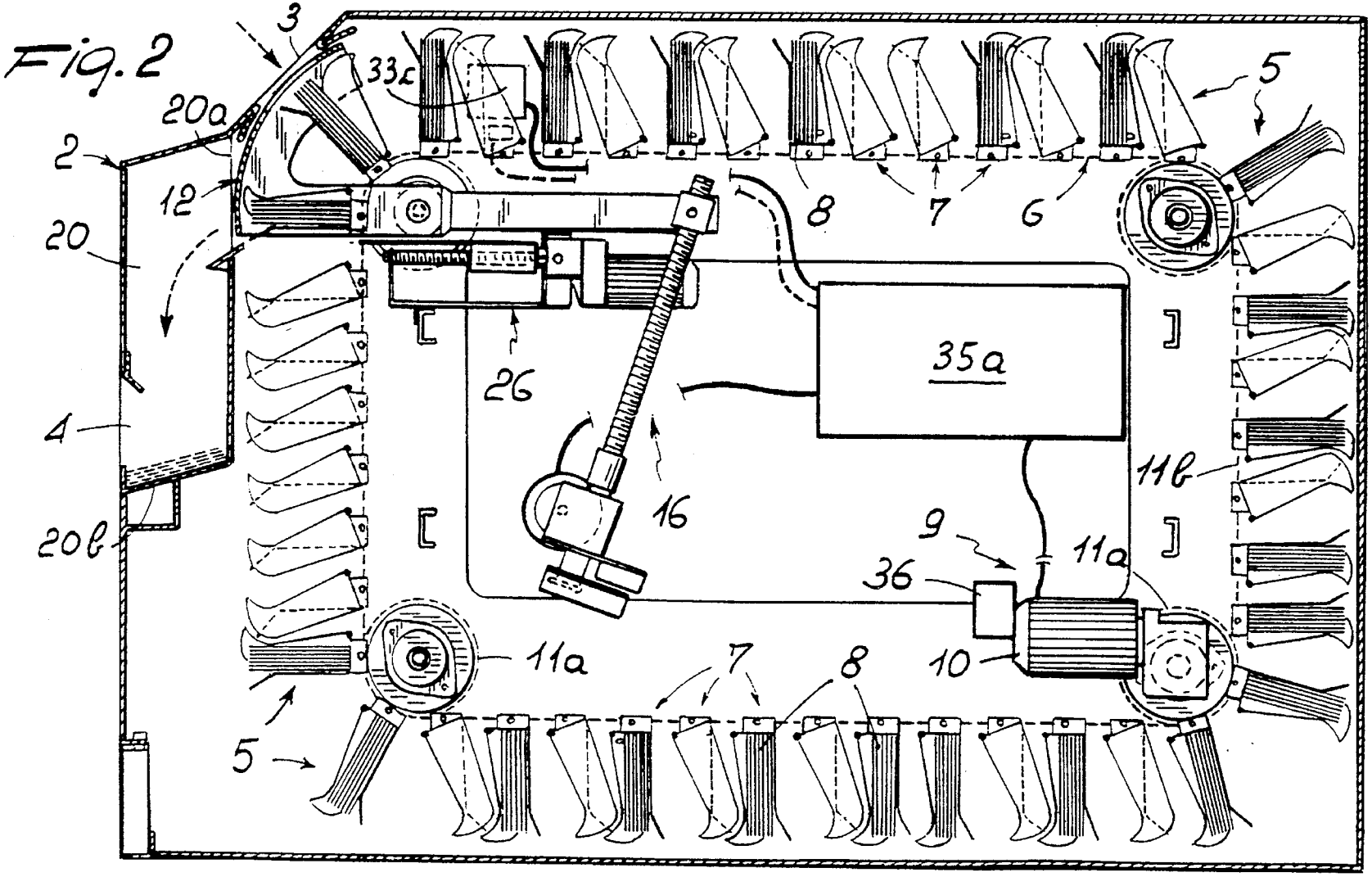
FIG. 2 is a sectional view of a portion of the apparatus.

As shown in particular in FIGS. 3 and 4, the ejector device 26 comprises a fork-shaped pusher 27 adapted to penetrate into the slots 25 and provided with a reciprocating motion in a rectilinear direction by actuating members 28. Said actuating members 28 comprise a threaded sleeve 29 operating screw 30 fit driven in rotation by a second electric motor 31.

FIG. 10 is a perspective view of the end portion of the fork-shaped pusher 27 and shows a cam-shaped expansion 27*a* of the pusher 27 designed to act on the cam follower 24*b*. This is for the purpose of opening the compartment 7 before the pusher 27 penetrates into the slots 25. Opening of the compartment by directly pressing on the banknotes 8 is thus avoided.

The side plates 21*c* and side walls 22*b* of each compartment 7 can exhibit inspection windows 32 disposed at the level of a sensor means 32*a* known per se, consisting for example of a photoelectric cell capable of establishing the presence or absence of banknotes within a compartment 7 moving in the vicinity of it.

Preferably such a sensor means 32*a* is located at an area immediately following the first opening 3, that is at an area the compartments 7 reach immediately after they have passed the banknote and valuables withdrawing or introduction areas. As shown in FIGS. 8*a* to 10, detection members 33 are also provided for detecting the amount of banknotes or valuables contained in each compartment 7. Said detection members 33 are placed within the protection casing 2 and operate by detecting the mutual position of the opposite portions or jaws 21, 22 of each compartment 7. As already pointed out, the mutual position of the laws 21, 22 and in particular the inclination of the second jaw 22 unfastened to the chains 11*b* depends on the amount of banknotes or valuables inserted between the jaws. In particular it is provided that the detection members 33 be of the optical read type. A control strip 34*a* carrying a bar code for example, is placed on the first jaw 21 whereas the second jaw 22 is such shaped that it exhibits a locating border 34*b* in register with the control strip 34*a*. Said locating border 34*b*, due to the second jaw 22 being more or less close to the first jaw causes the gradual uncovering of the control strip 34*a*. An optical reader 34*c* placed for example in the vicinity of the sensor means 32*a* detects the uncovered portion of the control strip 34*a*, thereby identifying the banknote and valuables present therein.

Such an amount is correlated with the total amount of money present and, under particular situations, by the use of banknotes of the same denomination, it closely corresponds to the total amount of money present therein. In addition, knowing the filling degree of each compartment is necessary in order to avoid any waste of space and to be able to supply the substantially empty compartments with new banknotes.

Finally, provision is made for electronic means 35 adapted to control and manage the operation of the whole apparatus. In a complete embodiment of the apparatus 1, said electronic means may comprise a first electronic unit 35*a* internal to the protection casing 2 and to which the detecting members 33 and sensor means 32 are connected, a computer 35*b* provided with a keyboard 35*c* external to the protection casing 2 and connected thereto, and also an electronic identification device 35*d* connected to the computer 35*b*.

The electronic identification device 35*d* may be for example a magnetic card reader, said cards carrying data relating to a client for which a withdrawing or paying-in operation is being done.

The computer 35*b* is at least adapted: to store the overall amount put into each compartment 7 suitably identified by a respective code; to store at least the requested amount; to select one or more compartments 7 having overall contents tightly close to and at least equal to the requested money amount; to operate the drive and guide means 9 so as to stop such compartment or compartments close to the outlet 20*a*; and to carry out activation of the ejector device 26. In a simplified execution of the apparatus 1, the computer 35*b* may be omitted and the keyboard 35*c*, or a more simplified type thereof, may be connected to the first electronic unit 35*a*, suitably arranged.

In addition, a remote-control locking device 36 can be fitted in the protection casing 2, said device being adapted to prevent, after a radio-control for example, any further delivery of banknotes and valuables, due to stopping of the reduction gear 10, for example.

Operation of the apparatus 1 is as follows. Loading operations are carried out by introducing known and controlled amounts of banknotes or valuables, or amounts that are controlled at the time of loading by the detecting members 33. The compartments 7 are loaded completely or in part and are made accessible automatically and in succession. However each compartment 7 can be presented several times for being filled, as far as the detecting members 33 classify it as filled enough.

The subsequent operations for dispensing the requested banknote amounts communicated by an operator to the electronic means 35 are practically performed in an automatic manner too.

In fact the electronic means 35 selects one or more compartments 7 altogether having contents the value of which is very close by excess to the previously inputted request, and activates the movable unit 5, actuation means 16 of the movable partition 12 and ejector device 26, so that the involved compartment or compartments 7 are positioned close to the outlet 20*a* and the complete ejection to the emission channel 20 of the banknotes therein contained takes place. Any excess in the delivered banknotes, generally of a small amount, is signalled to the operator who is therefore able to easily and quickly take it into due account and subtract it from the delivered amount so that he will give a client the exactly requested amount.

The electronic means 35 can be such arranged that the operator is enabled to perform a new operation only if he has previously introduced again into one or more compartments 7 any banknote excess dispensed in the preceding operation, communicating the amount of said introduction.

As a variant to the above solution, the electronic means can be arranged in such a manner that the operator is not required to reintroduce the possible banknote excess, but he is required to consider said excess in the next delivery operation. In this case the electronic means 35 carries out a new selection of one or more compartments 7 based on the difference between the requested next amount and the possible excess previously delivered.

The introduction of the received banknotes during the normal cash operations is facilitated in that the operator can introduce the banknotes into a compartment 7 without being obliged to put them in a particular order and separate them depending on their denomination, so that time for paying-in operations is reduced to a minimum, obviously provided that the introduced amount is signalled to the electronic means 35.

If, on the contrary, it is possible to use the apparatus 1 for banknotes having all the same denomination, all the involved operations can be carried out even without the computer 35*b* and based only on the detections made by the detecting members 33.

The sensor means 32*a* introduces an additional control, that is even in the presence of possible jammings in the mutual movements of the jaws 21 and 22 it is possible to certainly know which compartments 7 are empty or have been emptied and which have been filled.

The electronic means 35 can also be programmed in such a manner that the progressive emptying of the compartments 7 is set on the basis of a predetermined frequency. In this way the necessary delay between a delivery operation and the next one, in the presence of criminal attempts to empty the apparatus, restrains money misappropriations without on the other hand jeopardizing the employees'life, as they cannot intervene for speeding up such operations.

The remote-control locking device 36 is a further ensurance that the apparatus is safe.

The apparatus 1 in accordance with the invention also puts into practice a method for automatically receiving and dispensing banknotes and valuables.

The method consists first of all in loading all or part of said compartments with established amounts of valuables or banknotes, that is in introducing into each compartment conveniently identified, an amount of banknotes of a controlled overall value. Such loading as done substantially enables the establishment of an exact correspondence between each compartment and the valuables or banknote amount contained therein.

According to the method, the banknotes are emitted to the outside of the protection casing according to delivery amounts the overall value of which exceeds or is equal to the required amounts.

The emission of these delivery amounts is carried out by selection and subsequent emptying of one or more compartments provided with overall contents very close to and at least equal to, that is not lower than, the required amount of banknotes.

Preferably any excess which may occur in each individual delivery amount with respect to the required amount is stored and automatically subtracted from a following requested amount. The difference thus resulting therefrom is used for giving rise to a new selection of one or more compartments having overall contents close to and at least equal to said difference.

As an alternative to the above described use of a possible excess, the method provides that the emission of a new delivery amount be conditioned to the loading of said possible excess amount into one or more compartments.

The invention achieves important advantages. In fact, not only the apparatus carries out an efficient protection against abusive drawings of banknotes and valuables contained therein, thereby greatly restricting losses, but is also adapted to increase speed of the money flow, at a bank counter for example, both during the paying-in step, that is when banknotes are being received, and during the withdrawal step, that is when banknotes are being dispensed.

Actually, in the introduction operations the operator is not obliged to divide the received banknote packs into the different denominations, and in the delivery operations he immediately has the availability of controlled money amounts exhibiting small surpluses with respect to the required amounts, which surpluses can be easily subtracted.

In conclusion, the method and apparatus of the invention make the work of a person designed to handle banknotes and valuables in general easier, quicker and less tiring. It is to be noted that the automated delivery of money is efficient in spite of the fact that the apparatus is not provided with facilites for counting said money. These facilites are rather expensive and bulky and for their use banknotes must be undamaged and disposed in an orderly manner.

On the contrary, by only carrying out a complete filling and emptying of one or more compartments, of varying contents and adapted to be differently combined with each other, it is possible to avoid high additional costs, big overall dimensions, delays and jammings, even if money is not stored in an orderly manner and by denominations.

In addition, the method and apparatus of the invention enable a constant and precise control on the total banknote and valuables amounts, by virtue of the fact that all available amounts are stored and verified.

I claim:

1. An apparatus for automatically receiving and dispensing banknotes and valuables, comprising:

a protection casing (2) having at least a first access opening (3);

compartments (7) adapted to contain banknotes and valuables, supported by said protection casing (2);

drive and guide means (9) for said compartments (7);

a movement path (6) for each of said compartments (7) controlled by said drive and guide means (9), shaped as a closed loop and extending within said protection casing (2);

said movement path (6) comprising at least one location disposed close to said at least a first access opening (3);

an electronic means (35) acting on said drive and guide means (9) and adapted to position each of said compartments (7) relative to said at least a first access opening (3), based on predetermined procedures and commands;

wherein an ejector device (26) is provided which is interlocked to said electronic means (35) and adapted to carry out a complete emptying of one of said compartments disposed at a location close to said at least a first access opening (3), said ejector device (26) comprising, within said protection casing (2), a pusher (27) and actuating members (29) for imparting a reciprocating motion to said pusher (27), and said compartments (7) exhibiting at least one slot (25) defining an operating channel for said pusher (27);

wherein two access openings are provided in said protection casing (2), a first access opening (3) being arranged for loading banknotes and valuables into each of said compartments (7) and a second access opening (4) being provided at said ejector device (26).

2. The apparatus as claimed in claim 1, wherein each of said compartments (7) is in the form of a gripper and exhibits first and second opposite jaws (21, 22) oscillatably engaged with each other against the action of closing spring means (23).

3. The apparatus as claimed in claim 1, wherein said compartments (7) are separated from each other and disposed mutually in succession, and where inflexible elements (11*a*) are provided which sequentially engage said compartments (7) in a manner adapted to altogether form a loop-shaped discontinuous movable unit (5).

4. The apparatus according to claim 1, wherein a movable partition (12) is provided within said protection casing (2) as well as actuation means (16) adapted to place said movable partition (12) to a position for alternately closing said first or second openings (3, 4), said actuation means (16) being activated by said electronic means (35).

5. The apparatus according to claim 1, wherein each of said compartments (7) is of expansible size and exhibits at least two opposite portions (21, 22) susceptible of being spaced apart from each other to an extent proportional to the amount of banknotes and valuables inserted between them.

6. The apparatus according to claim 5, wherein a movable partition (12) is provided within said protection casing (2) as well as actuation means (16) adapted to place said movable partition (12) to a position for alternately closing said first or second openings (3, 4), said actuation means (16) being activated by said electronic means (35).

7. The apparatus as claimed in claim 5, wherein detecting members (33) are provided internally of said protection casing (2), for detecting the amount of banknotes or valuables present in each of said compartments (7), said detecting members (33) being responsive to the mutual position of said opposite portions (21, 22) of each of said compartments (7), and being connected to said electronic means (35).

8. The apparatus as claimed in claim 7, wherein said detecting members (33) are embodied by an optical reader, the mutual movement of said opposite portions (21, 22) causing the gradual uncovering of a control strip (34*a*).

9. The apparatus as claimed in claim 5, wherein each of said compartments (7) is in the form of a gripper and exhibits first and second opposite jaws (21, 22) oscillatably engaged with each other against the action of closing spring means (23).

10. The apparatus as claimed in claim 5, wherein said compartments (7) are separated from each other and disposed mutually in succession, and where inflexible elements (11*a*) are provided which sequentially engage said compartments (7) in a manner adapted to altogether form a loop-shaped discontinuous movable unit (5).

* * * * *